US005277675A

United States Patent [19]

Shifferaw

[11] Patent Number: 5,277,675

[45] Date of Patent: Jan. 11, 1994

[54] RESILIENT EXERCISE BOARD

[76] Inventor: Tessema D. Shifferaw, 999 W. Cutting Blvd., Point Richmond, Calif. 94801

[21] Appl. No.: 912,552

[22] Filed: Jul. 13, 1992

[51] Int. Cl.[5] ..... A63B 5/08; A63B 5/10

[52] U.S. Cl. ..... 482/30; 482/52; 482/74; 482/142; 482/908

[58] Field of Search ..... 482/26, 27, 28, 30, 482/52, 74, 141, 142, 908, 23; 108/144; 248/161; 135/65, 77, 86

[56] References Cited

U.S. PATENT DOCUMENTS

| | | | |
|---|---|---|---|
| 2,376,776 | 5/1945 | Jones et al. | 135/86 |
| 3,356,367 | 8/1964 | Tewksbury | 482/26 |
| 3,371,928 | 3/1968 | Buddo | 482/30 |
| 3,634,895 | 1/1972 | Childers | 482/74 |
| 3,641,601 | 2/1972 | Sieg | 482/26 |
| 4,198,044 | 4/1980 | Holappa | 482/142 |
| 4,516,768 | 5/1985 | Gallaro | 482/26 |
| 4,629,181 | 12/1986 | Krive | 482/79 |
| 4,984,785 | 1/1991 | Wilkinson | 108/144 |
| 5,037,084 | 8/1991 | Flor | 108/144 |

FOREIGN PATENT DOCUMENTS

| | | | |
|---|---|---|---|
| 1348531 | 3/1974 | United Kingdom | 482/26 |

*Primary Examiner*—Robert Bahr
*Assistant Examiner*—Jeanne M. Mollo
*Attorney, Agent, or Firm*—Flehr, Hohbach, Test, Albritton & Herbert

[57] ABSTRACT

Resilient exercise board comprising a generally planar platform having a laminated structure comprising a substantially rigid substrate and a pad of resilient material on one side of the substrate, and a plurality of resilient feet on the side of the substrate opposite the pad for supporting the platform in a predetermined position relative to a supporting surface. The resilient feet have upper sections affixed to the substrate and lower sections which can be swung between positions beside and beneath the upper sections to adjust the height of the feet and thereby position the platform in different planes relative to the supporting surface. The resilient pad is covered by a flexible cover having a skid resistant upper surface. In one embodiment, the platform has resilient reinforcing elements on the under side of the substrate.

16 Claims, 3 Drawing Sheets

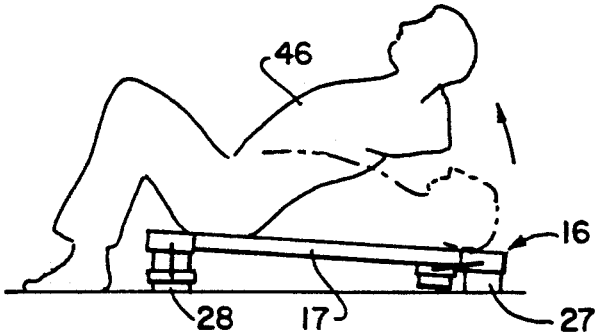
FIG. 6
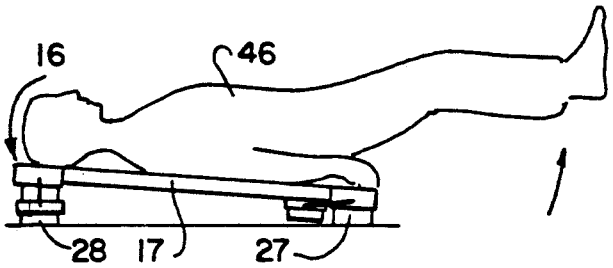
FIG. 7
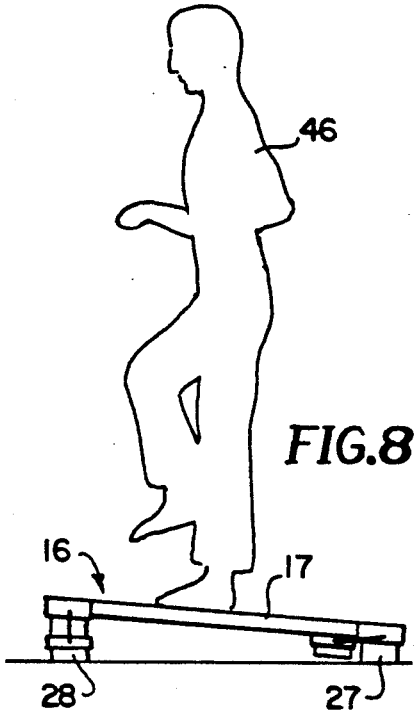
FIG. 8
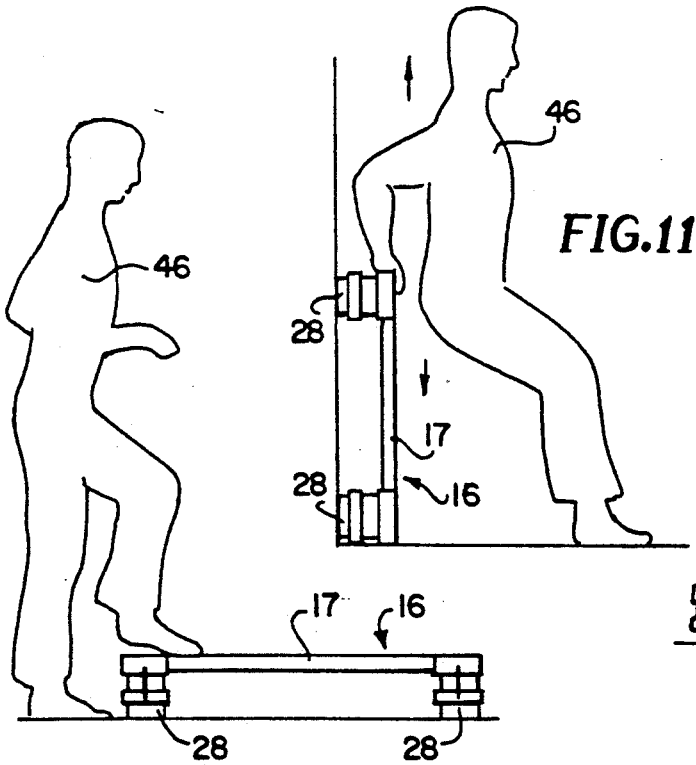
FIG. 11
FIG. 10
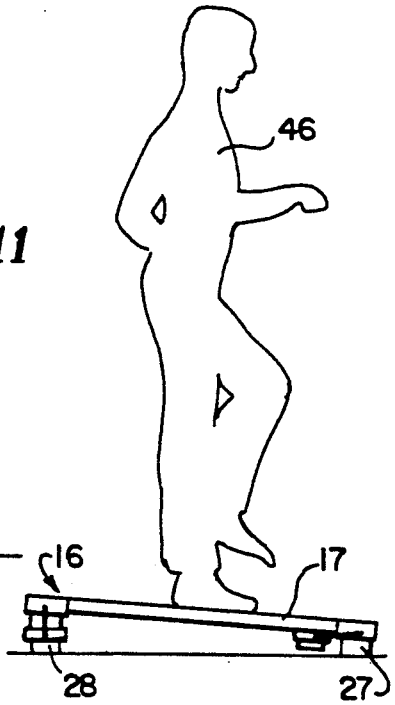
FIG. 9

RESILIENT EXERCISE BOARD

BACKGROUND OF THE INVENTION

1. Field of the Invention

This invention pertains generally to exercise equipment and, more particularly, to a trampoline-type exercise board that can be used for a variety of exercises such as running in place, aerobic exercise and jumping.

2. Description of Related Art

Trampolines and like devices generally have a strong flexible mat suspended from a plurality of peripheral springs. Since the mat does not provide a solid surface, feet impacting on the mat during exercise such as jumping and running in place have a tendency to move sideways, which can result in injuries to the ankles and/or legs.

OBJECTS AND SUMMARY OF THE INVENTION

In addition, trampolines and the like tend to reinforce the upward movement of persons bouncing thereon, which can cause a person to jump too high, resulting in overflexing of the legs and/or injury to the lower back. It can also present problem where overhead clearance is limited, e.g. in a room having a standard ceiling which is only eight feet above the floor.

It is in general an object of the invention to provide a new and improved exercise board.

Another object of the invention is to provide an exercise board of the above character which can be utilized for a variety of exercises such as running in place, aerobic exercise and jumping.

Another object of the invention is to provide an exercise board of the above character which overcomes the limitations and disadvantages of trampolines and like devices heretofore provided.

These and other objects are achieved in accordance with the invention by providing a resilient exercise board comprising a generally planar platform having a laminated structure comprising a substantially rigid substrate and a pad of resilient material on one side of the substrate, and a plurality of resilient feet on the side of the substrate opposite the pad for supporting the platform in a predetermined position relative to a supporting surface. The resilient feet have upper sections affixed to the substrate and lower sections which can be swung between positions beside and beneath the upper sections to adjust the height of the feet and thereby position the platform in different planes relative to the supporting surface. The resilient pad is covered by a flexible cover having a skid resistant upper surface. In one embodiment, the platform has resilient reinforcing elements on the under side of the substrate.

BRIEF DESCRIPTION OF THE DRAWINGS

FIGS. 6–11 are diagrammatic side elevational views illustrating the embodiment of FIG. 1 in use for performing different exercises.

DETAILED DESCRIPTION

Figure 1:
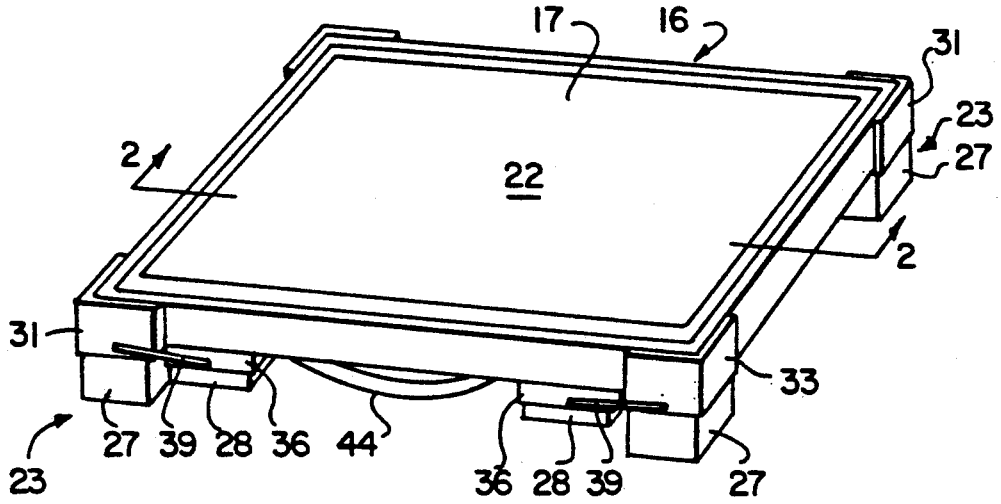
FIG. 1 is an isometric view of one embodiment of a resilient exercise board according to the invention.

As illustrated in the drawings, the exercise board 16 comprises a rectangular, generally planar platform 17 which has a substantially rigid substrate 18 fabricated of a suitable material such as wood, a rigid plastic or a composite wood product. In one presently preferred embodiment, the substrate is fabricated of plywood having a thickness on the order of ½ to ¾ inch.

The platform is of sufficient size to permit a person to perform exercises such as running in place and jumping thereon. In one embodiment, for example, the platform has a surface area on the order of 24 to 36 inches square.

The platform is of laminated construction and has a pad 19 of resilient material on the upper side of the substrate. The pad is fabricated of a rubber-like material such as ethylene vinyl acetate having a thickness on the order of 1 to 1½ inches and is coextensive in lateral dimension with the substrate.

The platform also includes a flexible cover 21 which overlies the resilient pad and has a skid resistant upper surface 22. The cover can be fabricated of any suitable material such as rubber or a rubberized material.

Resilient feet 23 are provided on the under side of the substrate toward the corners of the platform and are fabricated of a rubber-like material such as neoprene SE 42 which is denser or stiffer than the pad on the upper side of the substrate.

Figure 3:
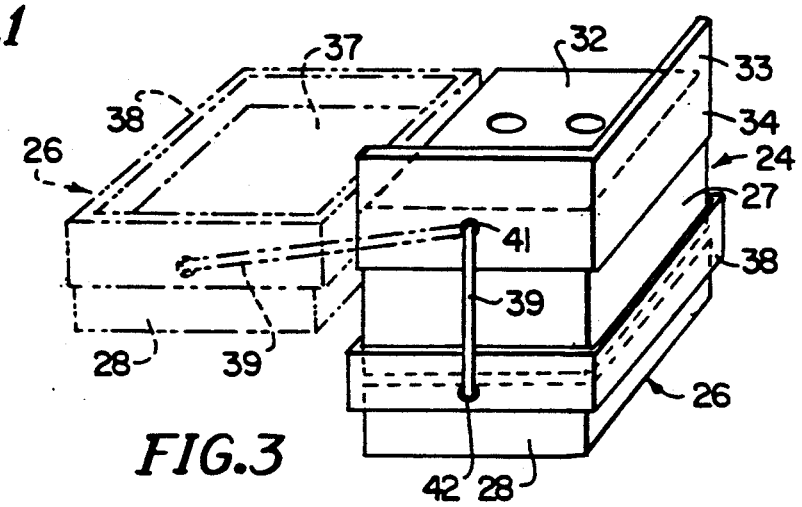
FIG. 3 is an enlarged isometric view of one of the resilient feet in the embodiment of FIG. 1.

The feet are adjustable in height to permit the platform to be positioned in different planes relative to the floor or other supporting surface, e.g. at different heights and at different angles of inclination. In the embodiment illustrated, this adjustment is provided by forming each of the feet in an upper section 24 and a lower section 26. The upper sections are affixed to the under side of the platform by screws, adhesive or other suitable means, and the lower sections are attached to the substrate and upper sections in a manner which permits them to be swung between a retracted position beside the upper sections and an extended position beneath the upper sections. In FIG. 3, the feet are shown in full lines in the extended position and in dashed lines in the retracted position.

The two sections of the resilient feet can be of any suitable dimension. In one present embodiment, each upper section comprises a block 27 of the resilient material having a length on the order of 4 inches, a width on the order of 3 inches and a thickness on the order of 4 inches, and each lower section comprises a block 28 of the same material of similar lateral dimensions and a thickness on the order of 2 inches.

Each upper foot section also includes a cornerpiece 31 which provides lateral support for the block of resilient material in that section. Each cornerpiece has a horizontally extending base plate 32 which is positioned between the upper surface of the block and the lower surface of the substrate, an L-shaped upper side flange 33, and a peripheral lower side flange or skirt 34. The base plate is positioned at the junction of the upper and lower flanges, with the upper flange extending along the side edges of the platform at the corner and the lower flange extending peripherally about the upper portion of the foot block. The cornerpieces are fabricated of a rigid material such as ABS plastic.

Each lower foot section has a retainer 36 comprising a base plate 37 and a peripheral skirt or flange 38. The base plate is positioned at the centerline of the skirt, and the upper side of the lower block 28 is affixed to the underside of the base plate by suitable means such as an adhesive. The upper portion of the skirt and the upper surface of the base plate form a recessed area or socket in which the lower portion of the upper foot block is received when the foot is extended. The retainers are also fabricated of a rigid material such as ABS plastic.

Each lower foot section is mounted to the upper foot section by an elastic cord 39 of the type commonly known as a "bungy" cord or a shock cord. The elastic cord passes through openings 41, 42 in the end portions of flange 34 and skirt 38 and through a slot or groove (not shown) in the upper portion of block 28, with the end portions of the cord being affixed to cornerpiece 31. In the retracted position, the elastic cord holds the lower foot section against the inner side of the upper section, and in the extended position, the cord holds the lower section on the lower side of the upper section.

A handle 44 is attached to the under side of the platform to facilitate carrying of the exercise board. The handle can be of any suitable construction, and in the embodiment illustrated, it comprises a strap of flexible material affixed at its ends to the under side of the substrate.

Figure 2:
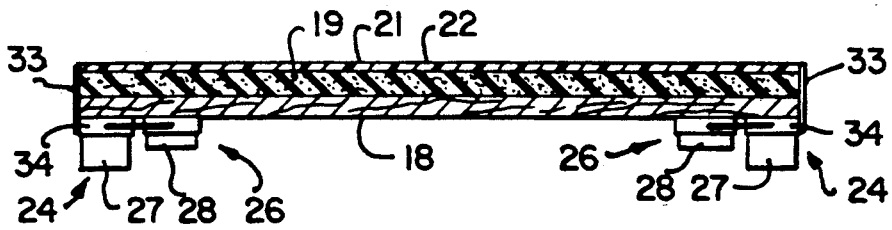
FIG. 2 is a cross-sectional view taken along line 2—2 in FIG. 1.
Figure 4:
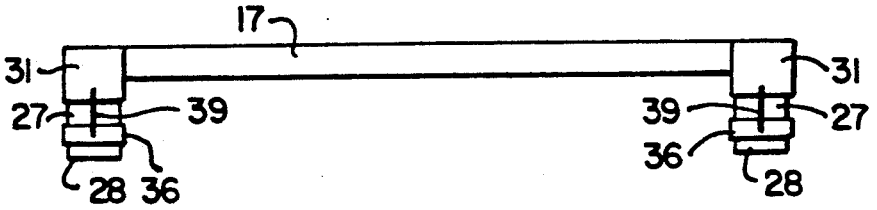
FIGS. 4 and 5 are side elevational views of the embodiment of FIG. 1, showing the resilient feet in different positions.
Figure 5:
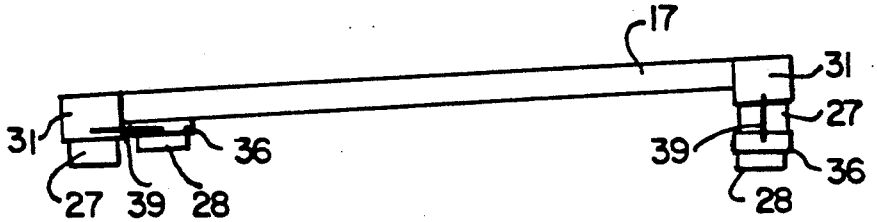

In FIGS. 1 and 2, all four of the resilient feet are illustrated in the retracted position, with the platform spaced about 6 inches above and parallel to the floor or other supporting surface. In FIG. 4, all four feet are all extended, and the platform is once again level, but now at a height of about 8 inches above the floor or supporting surface. In FIG. 5, the feet on the front side of the platform are retracted, the feet at the rear are extended, and the platform is inclined. If desired, the platform can also be inclined be extending the legs at the front or on one side of the platform.

FIGS. 6–11 illustrate some of the exercised which can be done with the exercise board of the invention. FIG. 6 shows a person 46 doing sit-ups on the board, with the platform inclined and the person facing uphill. FIG. 7 shows a person doing leg raises, with the platform inclined and the person facing downhill. FIGS. 8 and 9 show a person jogging or running in place, with the platform inclined and the person running uphill and downhill, respectively. FIG. 10 shows a person doing an aerobic step exercise, with the platform raised and level, and FIG. 11 shows a person doing a triceps pull-up exercise, with the platform in a vertical position with one edge resting on the floor and the feet extended and resting against a wall.

Figure 12:
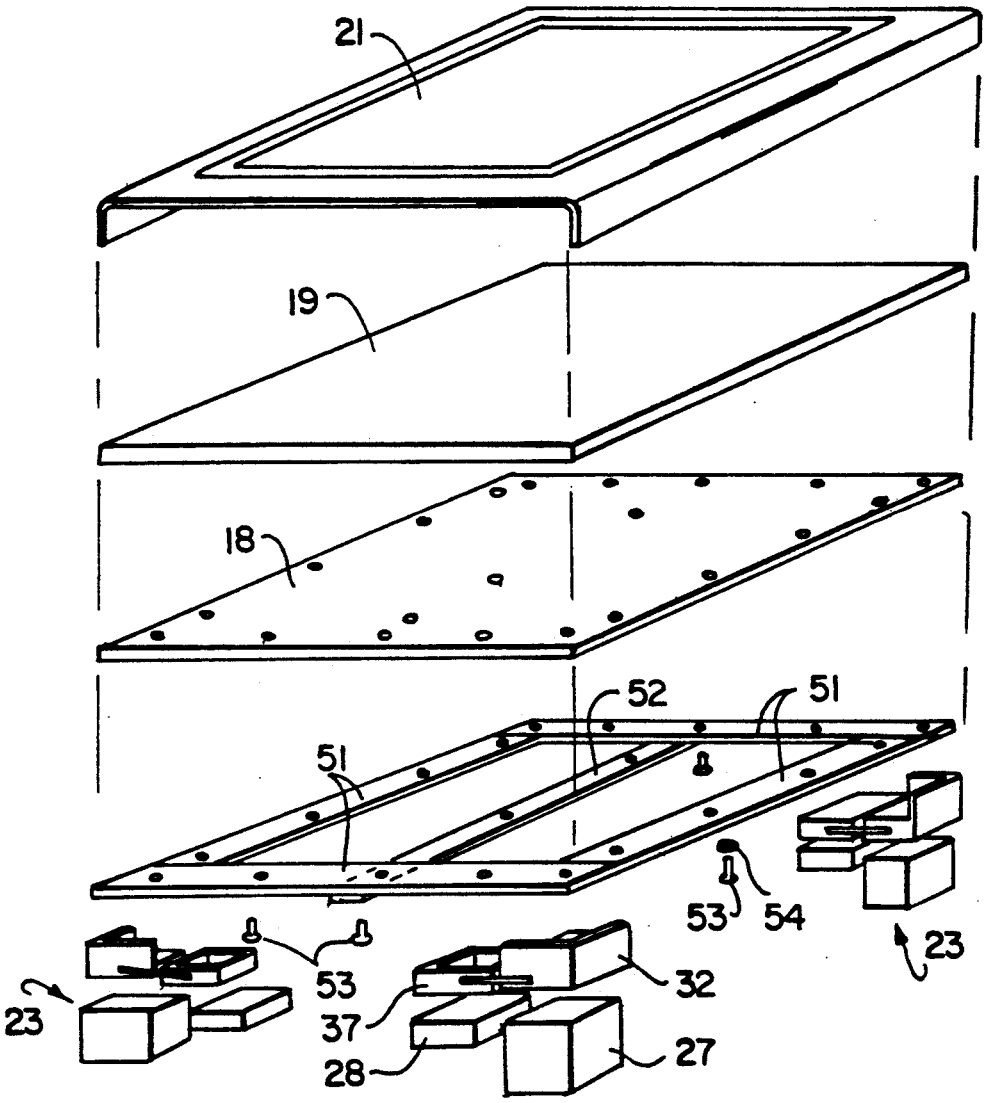
FIG. 12 is an exploded isometric of another embodiment of an exercise board according to the invention.

The embodiment of FIG. 12 is generally similar to that of FIG. 1, and like reference numerals designate corresponding elements in the two embodiments. In the embodiment of FIG. 12, however, the platform is provided with resilient reinforcing elements 51, 52 on the under side of substrate 18. These elements are fabricated of a resilient material such as spring steel bars having a width on the order of about 2 to 2½ inches and a thickness on the order of ¼ inch. They provide reinforcing for the plywood substrate without detracting from the resilient quality of the platform, making it possible for the plywood substrate to be even thinner than ½ inch. Elements 51 extend along the peripheral margins of the substrate, and element 52 extends centrally between two of the other elements. The resilient elements are secured the under side of the substrate by screws 53 with lock washers 54 to prevent the screws from vibrating loose when the board is in use.

Peripheral reinforcing elements 51 are disposed in a common plane beneath the substrate, with the end portions of those elements bearing upon resilient feet 23. Central element 52 is positioned on the under sides of the two peripheral elements between which it extends and is thus spaced from the under side of the substrate by a distance corresponding to the thickness of the peripheral elements.

Operation and use of the embodiment of FIG. 12 is similar to that hereinbefore described in connection with the embodiment of FIG. 1. However, as noted above, the reinforcing elements make it possible to use a thinner substrate in the embodiment of FIG. 12 than in the embodiment of FIG. 1.

The invention has a number of important features and advantages. It provides a resilient support which reduces impact without throwing a person like a trampoline does. It is readily carried and stored, and can be used for performing a wide variety of exercises. It is inexpensive, does not make any noise and can be used almost anywhere.

It is apparent from the foregoing that a new and improved exercise board have been provided. While only certain presently preferred embodiments have been described in detail, as will be apparent to those familiar with the art, certain changes and modifications can be made without departing from the scope of the invention as defined by the following claims.

I claim:

1. A resilient exercise board comprising a generally rectangular platform having a laminated structure comprising a horizontally extending substantially rigid substrate and a pad of resilient material on the upper side of the substrate, a plurality of resilient feet positioned toward the corners of the platform on the under side of the substrate and engagable with a supporting surface, and flat bars of resilient spring material extending between the feet along opposing side margins of the platform with major surfaces of the bars flat against the under side of the substrate.

2. The resilient exercise board of claim 1 wherein at least a portion of the resilient feet are adjustable in height so that the platform can be positioned in different planes relative to the supporting surface.

3. The resilient exercise board of claim 1 wherein the substrate is fabricated of plywood having a thickness on the order of ½ to ¾ inch, and the pad is fabricated of ethylene vinyl acetate having a thickness on the order of 1 to 1½ inches.

4. The resilient exercise board of claim 1 wherein the platform further comprises a flexible cover overlying the resilient pad and having a skid resistant outer surface.

5. The resilient exercise board of claim 1 wherein the bars of resilient spring material are affixed to the resilient feet and to the lower side of the substrate.

6. The resilient exercise board of claim 5 including an additional bar of resilient spring material extending centrally of the substrate between the bars which extend along the opposing side margins.

7. The resilient exercise board of claim 5 wherein each of the bars of resilient spring material comprises a bar of spring steel having a width on the order of 2 to 2½ inches and a thickness on the order of ¼ inch.

8. A resilient exercise board comprising a generally planar platform having a laminated structure comprising a substantially rigid substrate and a pad of resilient material on one side of the substrate, and a plurality of resilient feet on the side of the substrate opposite the pad, each of said feet having an upper section affixed to the substrate and a lower section mounted for swinging movement between a retracted position beside the upper section and an extended position beneath the upper section.

9. The resilient exercise board of claim 8 wherein the lower section of each of the resilient feet is mounted to the upper section by an elastic cord.

10. The resilient exercise board of claim 8 wherein each of the upper foot sections comprises a block of resilient material having a thickness on the order of 4 inches, and each of the lower foot sections comprises a block of resilient material having a thickness on the order of 2 inches.

11. A resilient exercise board comprising a substantially rigid, generally rectangular substrate having a major surface of sufficient lateral extent to receive a person who is exercising, a pad of resilient material overlying the major surface and being substantially coextensive laterally with the substrate, a cover having a skid resistant upper surface overlying the resilient pad, and resilient feet positioned beneath and toward the corners of the substrate, each of said resilient feet having an upper section affixed to the lower side of the substrate, a lower section movable between a retracted position beside the upper section and an extended position beneath the upper section, an elastic cord interconnecting the upper and lower sections, and a flange extending peripherally of the lower section for retaining the lower section in position beneath the upper section.

12. The resilient exercise board of claim 11 wherein each of the upper foot sections has a thickness on the order of 4 inches, and each of the lower foot sections has a thickness on the order of 2 inches.

13. The resilient exercise board of claim 12 wherein the substrate comprises a wooden board having a thickness on the order of ½ to ¾ inch, and the resilient pad is fabricated of ethylene vinyl acetate and has a thickness on the order of 1 to 1½ inches.

14. A resilient exercise board comprising a substantially rigid, generally rectangular substrate having an upper surface of sufficient lateral extent to receive a person who is exercising, a pad of resilient material overying the upper surface and being substantially coextensive laterally with the substrate, a cover having a skid resistant upper surface overlying the resilient pad, resilient feet positioned beneath and toward the corners of the substrate, and a plurality of flat bars of resilient spring material affixed to the resilient feet and to the lower side of the substrate and extending between the feet along opposing side margins of the platform with major surfaces of the bars flat against the under side of the substrate.

15. The resilient exercise board of claim 14 wherein each of the flat bars comprises a bar of spring steel having a width on the order of 2 to 2½ inches and a thickness on the order of ¼ inch.

16. The resilient exercise board of claim 14 including an additional resilient element spaced from the lower surface of the substrate and extending centrally of the substrate between the flat bars of resilient spring material.

* * * * *